US006348433B1

(12) United States Patent
Jimbo et al.

(10) Patent No.: US 6,348,433 B1
(45) Date of Patent: Feb. 19, 2002

(54) DIAZO COMPOUND AND HEAT-SENSITIVE RECORDING MATERIAL

(75) Inventors: Yoshihiro Jimbo; Kimi Ikeda, both of Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/443,296

(22) Filed: Nov. 19, 1999

(30) Foreign Application Priority Data

Feb. 22, 1999 (JP) ..... 11-043173

(51) Int. Cl.[7] ..... B41M 5/26; G03C 1/52
(52) U.S. Cl. ..... 503/218; 503/215
(58) Field of Search ..... 503/215, 216, 503/217, 218

(56) References Cited

U.S. PATENT DOCUMENTS 5,773,186 A 6/1998 Takashima et al. ..... 430/138
6,034,033 A * 3/2000 Aono et al. ..... 503/200

* cited by examiner

*Primary Examiner*—Bruce H. Hess
(74) *Attorney, Agent, or Firm*—Sughrue, Mion, Zinn, Macpeak & Seas, PLLC

(57) ABSTRACT

The present invention discloses a diazo compound represented by any one of the following general formulas (I) to (III). Also, the present invention discloses a heat-sensitive recording material including a substrate and a heat-sensitive layer provided on the substrate, the heat-sensitive recording layer including a diazo compound which is represented by any one of the following general formulas (I) to (III), and a coupler to react with the diazo compound to color the same. According to the present invention, there is provided a diazo compound having a high density of color-developing and good storability, and a heat-sensitive recording material using the diazo compound which has excellent color-developing property, light-resistance property, and storage stability before use.

general formula (I)

general formula (II)

general formula (III)

6 Claims, No Drawings

DIAZO COMPOUND AND HEAT-SENSITIVE RECORDING MATERIAL

BACKGROUND OF THE INVENTION

1. Field of the Invention

The present invention relates to a diazo compound and a heat-sensitive recording material using the same. More particularly, the present invention relates to a diazo compound which is stable in light having a longer wavelength than 350 nm, and to a heat-sensitive recording material which shows good storage stability before use (storage stability of a heat-sensitive recording material before being subjected to recording) and good density of color-development upon thermal recording and is stable in light having a longer wavelength than 350 nm.

2. Description of the Related Art

Diazo compounds are compounds having very high chemical activity, and easily react with compounds called couplers, (e.g., phenol derivatives and compounds having an active methylene group) to form an azo dye, and also are light-sensitive and lose their activity when decomposed due to irradiation by light. Therefore, diazo compounds have been used as light recording materials such as diazo copies (see, "Fundamentals of Photographic Technology, Non-Silver Salt Photography Volume (Shashin Kogaku no Kiso, Higinen Shashin Hen)", edited by Nippon Shashin Gakkai (Japan Photographic Society, Corona Co., (1982), pp. 89 to 117, and pp. 182 to 201).

Further, by utilizing the property of diazo compounds that they lose their activity due to decomposition by light, diazo compounds have recently been used in recording materials which require fixing of images. As an example, there has been proposed a light fixing type heat-sensitive recording material in which a recording material having a recording layer which includes a diazo compound and a coupler is heated in accordance with image signals and the diazo compound and the coupler are reacted to form images, and thereafter, the images are fixed by irradiation of light (Hirotsugu Sato et al., "Journal of the Image Electronics Society (Gazo Denshi Gakkai Shi)", Vol. 11. No. 4 (1982), pp. 290 to 296, etc.).

However, these recording materials using as a color-forming element a diazo compound have a drawback in that the chemical activity of the diazo compound is extremely high, and the diazo compound thermally decomposes gradually such that the reactivity thereof is lost. Moreover, when the recording material is stored in a bright place for a long time, photolysis of the diazo compound is accelerated, and, when such a recording material is used for image recording after storing, the density of color-development of the image portion tends to be reduced.

SUMMARY OF THE INVENTION

An object of the present invention is to solve the aforementioned problems. That is, the object of the present invention is to provide a diazo compound which has a sufficiently high density of color-development and good storage stability, and a heat-sensitive recording material using the diazo compound which shows good color-developing properties, light-resistance properties, storage stability before use, and handling properties in light places.

To achieve the aforementioned object, the present invention has following features.

In a first aspect of the present invention, the present invention provides a diazo compound represented by the following general formulae (I)–(III):

general formula (I)

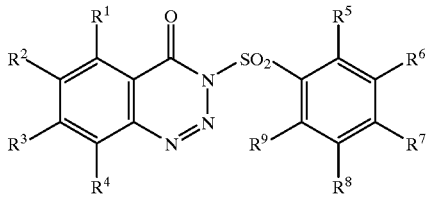

wherein, in general formula (I), each of $R^1$, $R^2$, $R^3$ and $R^4$ independently represents any one of the groups selected from a group comprising a hydrogen atom, a halogen atom, an alkyl group, an aryl group, —$OR^{10}$, —$SR^{10}$, —$COOR^{10}$, —$CONR^{10}R^{11}$, —$SO_2R^{10}$, —$SO_2NR^{10}R^{11}$, —$COR^{10}$, a nitro group and a cyano group, each of $R^5$, $R^6$, $R^7$, $R^8$ and $R^9$ independently represents any one of the groups selected from a group comprising a hydrogen atom, a halogen atom, an alkyl group, an aryl group, —$OR^{12}$, —$COOR^{12}$, —$CONR^{12}R^{13}$, —$SO_2R^{12}$, —$SO_2NR^{12}R^{13}$, —$COR^{12}$, a nitro group and a cyano group, each of $R^{10}$, $R^{11}$, $R^{12}$ and $R^{13}$ independently represents any one of the groups selected from a group comprising a hydrogen atom, an alkyl group and an aryl group, here, at least one of the $R^1$, $R^2$, $R^3$ and $R^4$ represents any one of the groups selected from a group comprising —$COOR^{10}$, —$CONR^{10}R^{11}$, —$SO_2R^{10}$, —$SO_2NR^{10}R^{11}$, a nitro group and a cyano group, and at least one of the $R^5$, $R^6$, R7, $R^8$ and $R^9$ represents any one of the groups selected from a group comprising —$COOR^{12}$, —$CONR^{12}R^{13}$, —$SO_2R^{12}$, —$SO_2NR^{12}R^{13}$, a nitro group and cyano group.

general formula (II)

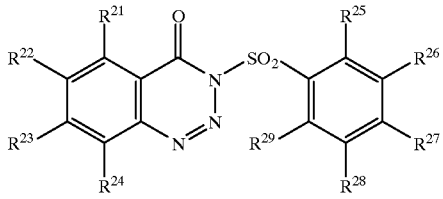

wherein, in general formula (II), each of $R^{21}$, $R^{22}$, $R^{23}$ and $R^{24}$ independently represents any one of the groups selected from a group comprising a hydrogen atom, a halogen atom, an alkyl group, —$OR^{30}$, —$COOR^{30}$, —$SO_2R^{30}$, a nitro group, a cyano group and —$CONR^{30}R^{31}$, each of $R^{25}$, $R^{26}$, $R^{27}$, $R^{28}$ and $R^{29}$ independently represents any one of the groups selected from a group comprising a hydrogen atom, a halogen atom, —$OR^{32}$, —$COOR^{32}$, —$CONR^{32}R^{33}$, —$SO_2NR^{32}R^{33}$, a nitro group and a cyano group, each of $R^{30}$, $R^{31}$, $R^{32}$, and $R^{33}$ independently represents any one of the groups selected from a group comprising a hydrogen atom, an alkyl group and an aryl group, here, at least one of the $R^{21}$, $R^{22}$, $R^{23}$ and $R^{24}$ represents any one of groups selected from a group comprising —$CONR^{30}R^{31}$, —$COOR^{30}$, —$SO_2R^{30}$, a nitro group and a cyano group, and at least one of the $R^{25}$, $R^{26}$, $R^{27}$, $R^{28}$, and $R^{29}$ represents any one of the groups selected from a group comprising —$COOR^{32}$, —$CONR^{32}R^{33}$, —$SO_2NR^{32}R^{33}$, a nitro group and a cyano group.

general formula (III)

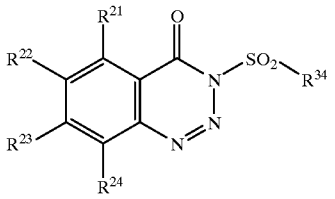

wherein, in general formula (III), each of $R^{21}$, $R^{22}$, $R^{23}$ and $R^{24}$ independently represents any one of the groups selected from a group comprising a hydrogen atom, a halogen atom, an alkyl group, —$OR^{30}$, —$COOR^{30}$, —$SO_2R^{30}$, a nitro group, a cyano group and —$CONR^{30}R^{31}$, each of $R^{30}$ and $R^{31}$ independently represents any one of the groups selected from a group comprising a hydrogen atom, an alkyl group and an aryl group, $R^{34}$ represents a group selected from the following monovalent groups, each of $R^{35}$ and $R^{36}$ independently represents an alkyl group or an aryl group, here, at least one of $R^{21}$, $R^{22}$, $R^{23}$, and $R^{24}$ represents —$CONR^{30}R^{31}$, —$COOR^{30}$, —$SO_2R^{30}$, a nitro group and a cyano group.

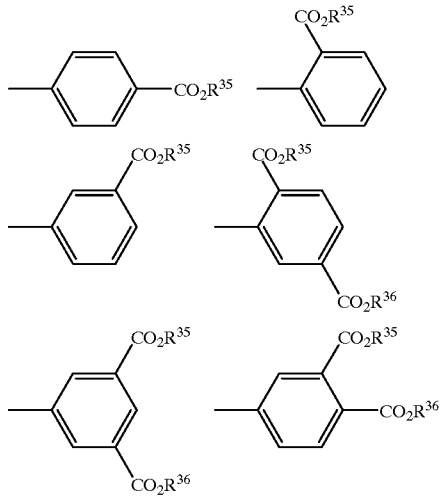

In a second aspect of the present invention, the present invention provides a heat-sensitive recording material, comprising: a substrate; and a heat-sensitive recording layer provided on said substrate. Said heat-sensitive recording layer including at least: a diazo compound; and a coupler to react with said diazo compound to color said diazo compound, said diazo compound being represented by one of the general formulae (I)–(III).

In a third aspect of the present invention, said diazo compound is encapsulated in a microcapsule and said microcapsule consists of at least one of urethane or urea.

In a fourth aspect of the present invention, said coupler is a compound represented by general formula (IV) or a resonance isomer of the compound:

general formula (IV)

$$E^1—CH_2—E^2$$

wherein in general formula (IV), each of $E^1$ and $E^2$ independently represents an electron attractive group, and $E^1$ and $E^2$ may combine with each other to form a ring.

In a fifth aspect of the present invention, said heat-sensitive recording material having the aforementioned aspects further comprises an organic base.

In a sixth aspect of the present invention, said heat-sensitive recording material having the aforementioned aspects further comprises a color-developing assistant and a protective layer provided on said heat-sensitive recording layer for protecting said heat-sensitive recording layer.

DESCRIPTION OF THE PREFERRED EMBODIMENTS

1. A diazo Compound Represented by General Formula (I)

general formula (I)

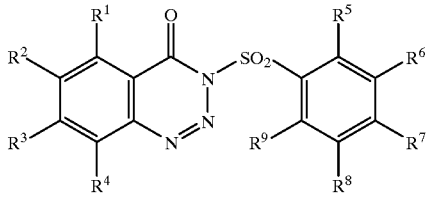

In general formula (I), each of $R^1$, $R^2$, $R^3$ and $R^4$ independently represents any one of the groups selected from a group comprising a hydrogen atom, a halogen atom, an alkyl group, an aryl group, —$OR^{10}$, —$SR^{10}$, —$COOR^{10}$, —$CONR^{10}R^{11}$, —$SO_2R^{10}$, —$SO_2NR^{10}R^{11}$, —$COR^{10}$, a nitro group and a cyano group. The halogen atom is preferably fluorine, chlorine, bromine or iodine, and, of these, fluorine and chlorine are especially preferable. The alkyl group may include. substituents, and is preferably an alkyl group having 1~20 carbon atoms, and is more preferably an alkyl group having 1~10 carbon atoms. Examples thereof include methyl, ethyl, n-propyl, i-propyl, n-butyl, n-hexyl, n-octyl, 2-ethylhexyl, 3,5,5-trimethylhexyl, dodecyl, 2-chloroethyl, 2-methanesulfonylethyl, 2-methoxyethyl, 2-benzoyloxyethyl, N,N-dibutylcarbamoylmethyl, 2-ethoxycarbonylethyl, butoxycarbonylmethyl, 2-isopropyloxyethyl, 2-(2,5-di-t-amylphenoxy)ethyl, 2-phenoxyethyl, 1-(4-methoxy phenoxy)-2-propyl, 1-(2,5-di-t-amylphenoxy)-2-propyl, benzyl, α-methylbenzyl, trichloromethyl, trifluoromethyl, 2,2,2-trifluoroethyl and the like. The aryl group may include substituents, and is preferably an aryl group having 6~30 carbon atoms. Examples thereof include phenyl, 4-methylphenyl, 2-chlorophenyl and the like.

Each of $R^{10}$ and $R^{11}$ independently represents any one of the groups selected from a group comprising a hydrogen atom, an alkyl group and an aryl group. The alkyl group may include substituents, and is preferably an alkyl group having 1~30 carbon atoms. Examples thereof include methyl, ethyl, n-propyl, i-propyl, n-butyl, i-butyl, 2-butyl, t-butyl, n-hexyl, n-octyl, 2-ethylhexyl, 3,5,5-trimethylhexyl, dodecyl, 2-chloroethyl, 2-methanesulfonylethyl, 2-methoxyethyl, 2-methoxypropyl, 2-benzoyloxyethyl, N,N-dibutylcarbamoylmethyl, 2-ethoxycarbonylethyl, butoxycarbonylmethyl, octyloxycarbonylmethyl, cyclohexyl, 2-isopropyloxyethyl, 2-(2,5-di-t-amylphenoxy) ethyl, 2-phenoxyethyl, 1-(4-methoxyphenoxy)-2-propyl, 1-(2,5-di-t-amylphenoxy)-2-propyl, benzyl, α-methylbenzyl, phenethyl, 3-phenylpropyl, allyl, methallyl, trichloromethyl, trifluoromethyl, 2,2,2-trifluoroethyl and the like. The aryl group may include substituents, and is preferably an aryl group having 6~30 carbon atoms. Examples thereof include phenyl, 2-methylphenyl, 3-methylphenyl, 4-methylphenyl, 4-ethylphenyl, 4-isopropylphenyl, 2-chlorophenyl, 4-chlorophenyl, 2-methoxyphenyl, 4-butoxyphenyl, naphthyl, 2,5-di-t-amylphenyl and the like.

In the aforementioned general formula (I), each of $R^5$, $R^6$, $R^7$, $R^8$, and $R^9$ independently represents any one of the groups selected from a group comprising a hydrogen atom, a halogen atom, an alkyl group, an aryl group, —$OR^{12}$, —$COOR^{12}$, —$CONR^{12}R^{13}$, —$SO_2R^{12}$, —$SO_2NR^{12}R^{13}$, —$COR^{12}$, a nitro group and a cyano group. The halogen atom is preferably fluorine, chlorine, bromine and iodine, and, of these, fluorine and chlorine are especially preferable. The alkyl group may include substituents, and is preferably an alkyl group having 1~30 carbon atoms, and is more preferably an alkyl group having 1~10 carbon atoms. Preferable examples thereof include methyl, ethyl, i-propyl, s-butyl, t-butyl, t-amyl and the like. The aryl group may include substituents, and is preferably an aryl group having 6~30 carbon atoms. Preferable examples thereof include phenyl, 2-methylphenyl, 3-methylphenyl, 2-chlorophenyl, 2,5-di-t-amylphenyl and the like.

Each of $R^{12}$ and $R^{13}$ independently represents any one of the groups selected from a group comprising a hydrogen atom, an alkyl group and an aryl group. The alkyl group and the aryl group may include substituents, and examples thereof are respectively the same as the preferable examples defined for $R^{10}$ and $R^{11}$.

Wherein, in general formula (I), at least one of $R^1$, $R^2$ $R^3$ and $R^4$ represent any one of the groups selected from a group comprising —$COOR^{10}$, —$CONR^{10}R^{11}$, —$SO_2R^{10}$, —$SO_2NR^{10}R^{11}$, a nitro group and a cyano group, and, of these, —$SO_2R^{10}$, a nitro group, a cyano group and —$COOR^{10}$ are especially preferable. At least one of $R^5$, $R^6$, $R^7$, $R^8$, and $R^9$ represent any one of the groups selected from a group comprising —$COOR^{12}$, —$CONR^{12}R^{13}$, —$SO_2R^{12}$, —$SO_2NR^{12}R^{13}$, a nitro group and a cyano group, and, of these, —$COOR^{12}$, —$CONR^{12}R^{13}$, a cyano group and a nitro group are especially preferable. Further, compounds represented by general formula (I) preferably have a molecular weight of 300 to 800. Moreover, it is preferable that at least one of $R^1$ to $R^4$ is any one of —$SO_2R^{10}$, a nitro group or —$COOR^{10}$, or at least one of $R^5$ to $R^9$ is any one of —$COOR^{12}$ or —$CONR^{12}R^{13}$, since solubility of the compound in an organic solvent is improved so that the compound is more useful when used as a color-developing component for a heat-sensitive recording material.

2. A Diazo Compound Represented by General Formula (II)

general formula (II)

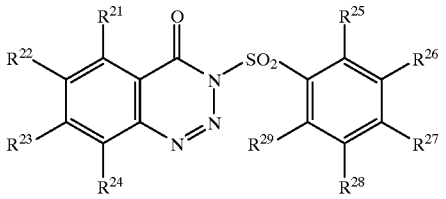

In general formula (II), each of $R^{21}$, $R^{22}$, $R^{23}$ and $R^{24}$ independently represents any one of the groups selected from a group comprising a hydrogen atom, a halogen atom, an alkyl group, —$OR^{30}$, —$COOR^{30}$, —$SO_2R^{30}$, a nitro group, a cyano group and —$CONR^{30}R^{31}$. Preferable examples of the halogen atom are the same as the preferable examples defined for $R^1$ to $R^4$. The alkyl group may include substituents, and examples thereof are the same as the preferable examples defined for $R^1$ to $R^4$.

Each of $R^{30}$ and $R^{31}$ independently represents any one of the groups selected from a group comprising a hydrogen atom, an alkyl group and an aryl group. The alkyl group and aryl group may include substituents, and preferable examples thereof are the same as the preferable examples defined for $R^{10}$ and $R^{11}$.

In general formula (II), each of $R^{25}$, $R^{26}$, $R^{27}$, $R^{28}$ and $R^{29}$ independently represents any one of the groups selected from a group comprising a hydrogen atom, a halogen atom, —$OR^{32}$, —$COOR^{32}$, —$CONR^{32}R^{33}$, —$SO_2NR^{32}R^{33}$, a nitro group and a cyano group. The halogen atom is preferably fluorine, chlorine, bromine and iodine, and, of these, fluorine and chlorine are especially preferable.

Each of $R^{32}$ and $R^{33}$ independently represents any one of the groups selected from a group comprising a hydrogen atom, an alkyl group and an aryl group. The alkyl group and aryl group may include substituents, and preferable examples thereof are the same as the preferable examples defined for $R^{10}$ and $R^{11}$.

Wherein, at least one of $R^{21}$, $R^{22}$, $R^{23}$ and $R^{24}$ represents any one of the groups selected from a group comprising —$CONR^{30}R^{31}$, —$COOR^{30}$, —$SO_2R^{30}$, a nitro group and a cyano group, and, of these, —$SO_2R^{30}$, a nitro group, a cyano group and —$COOR^{30}$ are especially preferable. At least one of $R^{25}$, $R^{26}$, $R^{27}$, $R^{28}$ and $R^{29}$ represents any one of the groups selected from a group comprising —$COOR^{32}$, —$CONR^{32}R^{33}$, —$SO_2NR^{32}R^{33}$, a nitro group and a cyano group, and, of these, —$COOR^{32}$, —$CONR^{32}R^{33}$, a cyano group and a nitro group are especially preferable. Further, compounds represented by general formula (II) preferably have a molecular weight of 300 to 800. Moreover, it is preferable that at least one of $R^{21}$ to $R^{24}$ is any one of —$SO_2R^{30}$, a nitro group or —$COOR^{30}$, or at least one of $R^{25}$ to $R^{29}$ is any one of —$COOR^{32}$ or —$CONR^{32}R^{33}$, since in such a case solubility of the compound in an organic solvent is improved so that the compound is more useful when used as a color-developing component for a heat-sensitive recording material.

3. A Diazo Compound Represented by General Formula (III)

general formula (III)

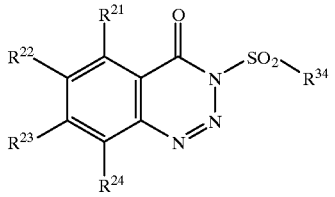

In general formula (III), each of $R^{21}$, $R^{22}$, $R^{23}$ and $R^{24}$ are respectively identical to $R^{21}$, $R^{22}$, $R^{23}$ and $R^{24}$ of general formula (II) and the preferable examples thereof are also identical.

In general formula (III), $R^{34}$ represents a group selected from the following monovalent groups, and, in the following monovalent groups, each of $R^{35}$ and $R^{36}$ independently represents an alkyl group or an aryl group. The alkyl group and aryl group may include substituents, and examples thereof are the same as the preferable examples defined for $R^{10}$ and $R^{11}$.

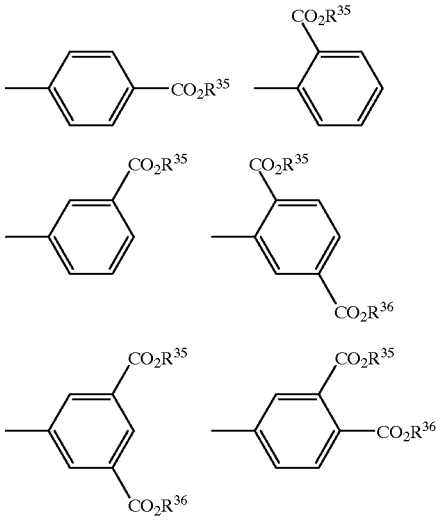

Wherein, at least one of $R^{21}$, $R^{22}$, $R^{23}$ and $R^{24}$ represents any one of the groups selected from a group comprising —$CONR^{30}R^{31}$, —$COOR^{30}$, —$SO_2R^{30}$, a nitro group and a cyano group, and, of these, —$SO_2R^{30}$, a nitro group, a cyano group and —$COOR^{30}$ are especially preferable. Further, compounds represented by general formula (III) preferably have a molecular weight of 300 to 800. Moreover, it is preferable that at least one of $R^{21}$ to $R^{24}$ is any one of —$SO_2R^{30}$, a nitro group or —$COOR^{30}$, since in such a case solubility of the compound in an organic solvent is improved so that the compound is more useful when used as a color-developing component for a heat-sensitive recording material.

Specific examples of the diazo compounds represented by the aforementioned general formulas (I) to (III) are the following compounds. However, it is to be noted that the diazo compound of the present invention is not limited to these examples.

A-1

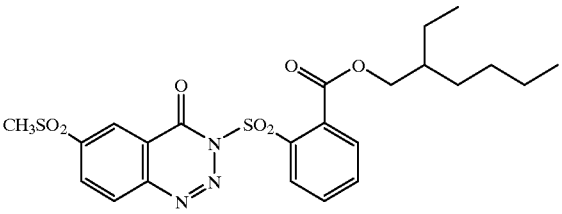

A-2

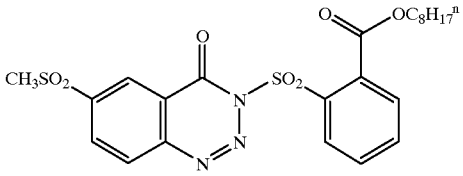

A-3

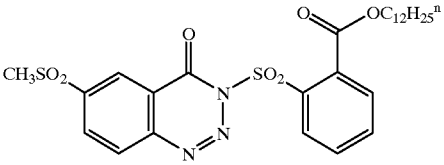

A-4

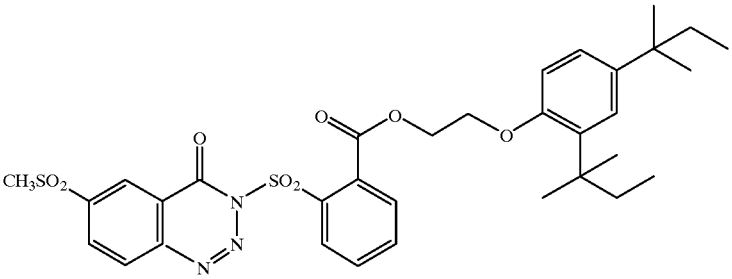

A-5

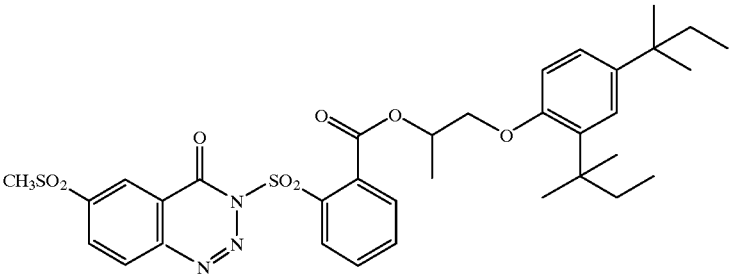

-continued
A-6
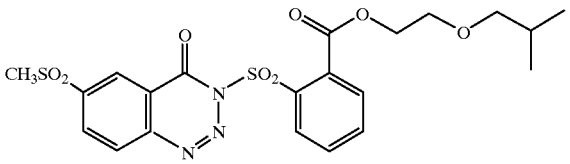
A-7
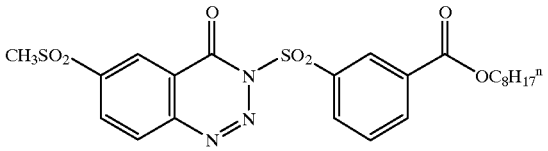
A-8
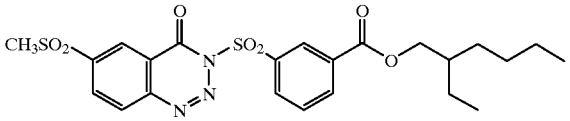
A-9
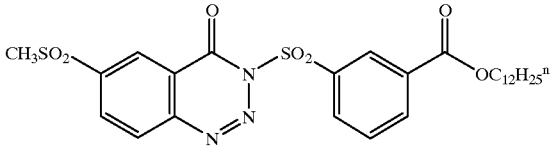
A-10
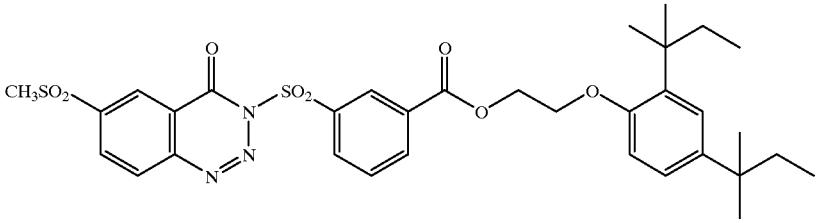
A-11
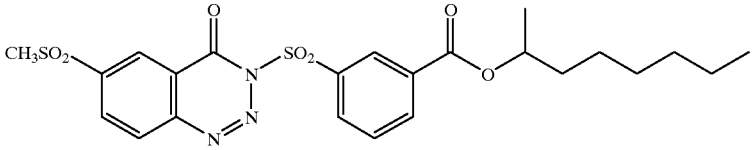
A-12
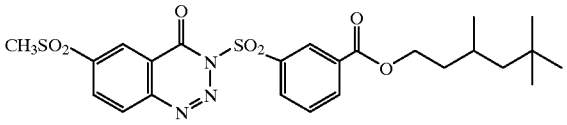
A-13
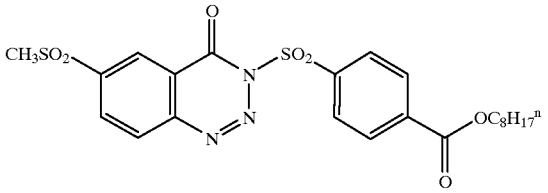
A-14
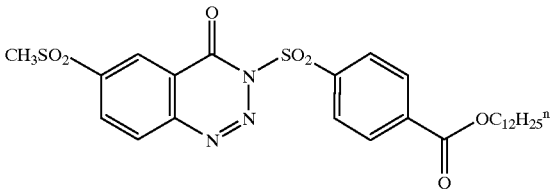
A-15
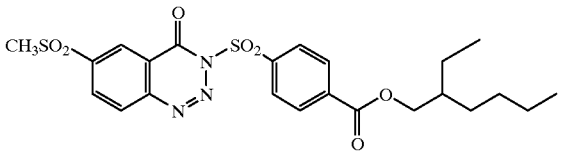
A-16
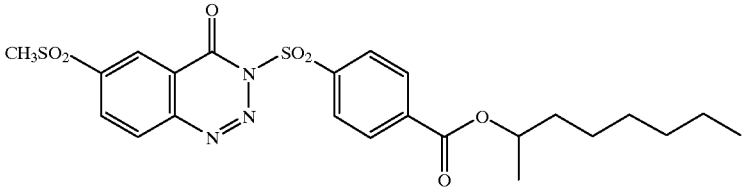

-continued
A-17
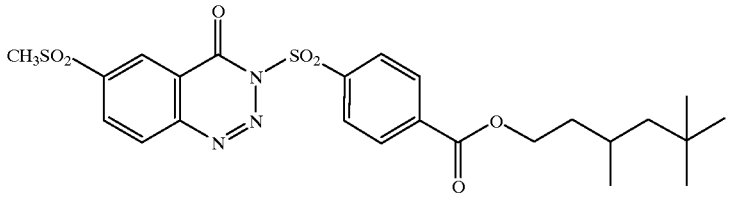
A-18
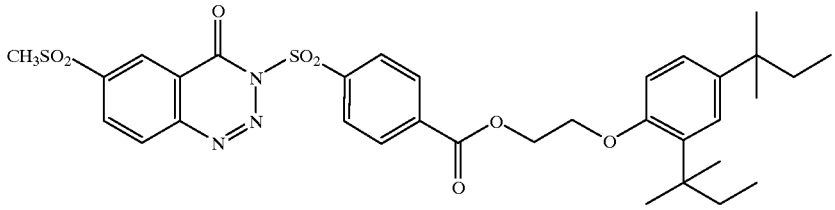
A-19
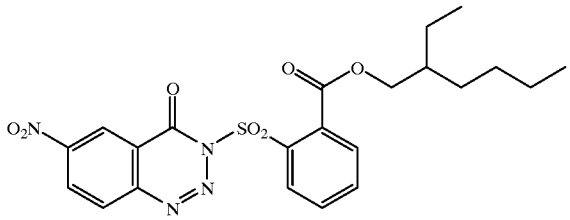
A-20
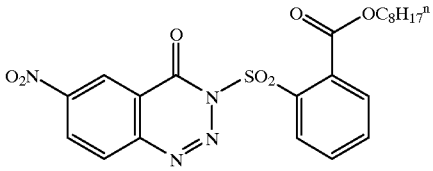
A-21
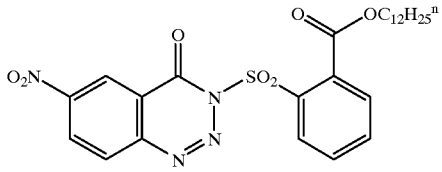
A-22
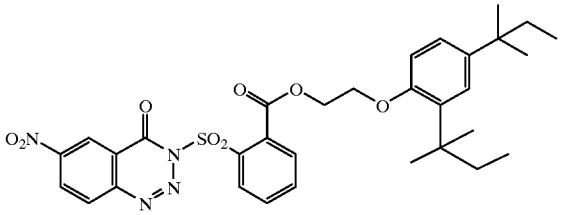
A-23
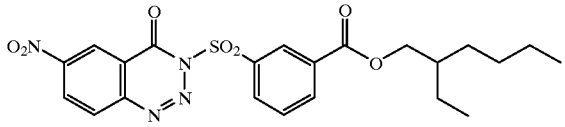
A-24
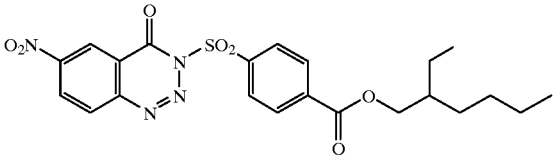
A-25
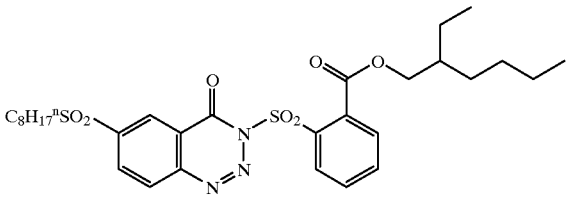
A-26
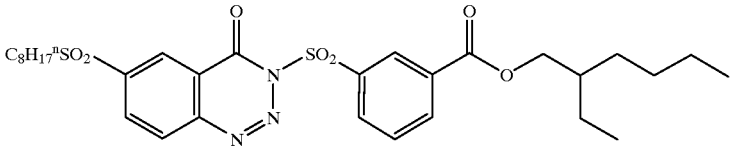

-continued
A-27
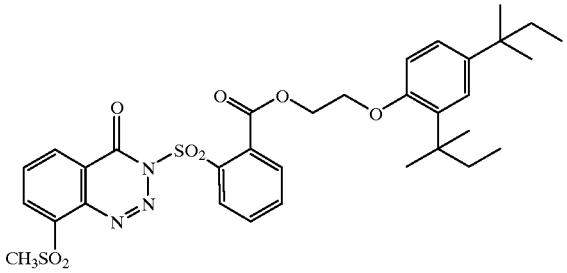
A-28
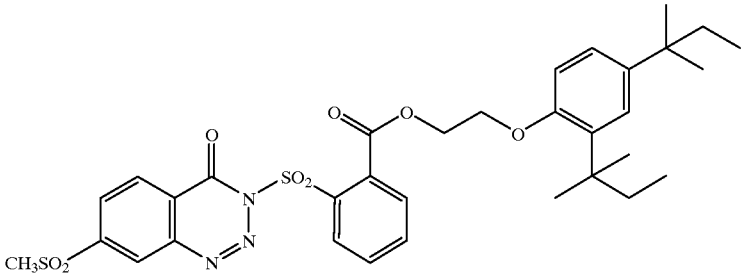
A-29
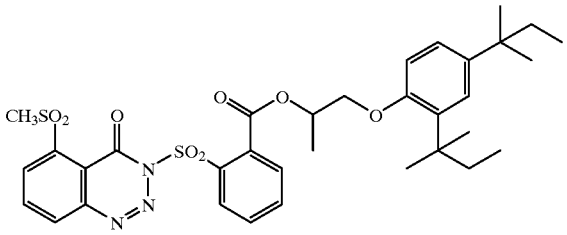
A-30
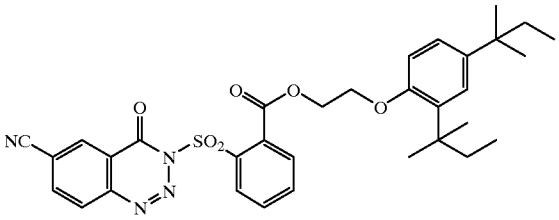
A-31
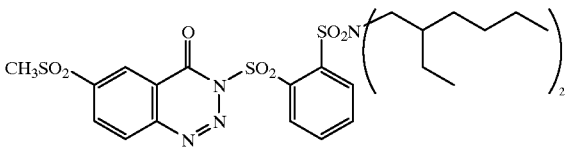
A-32
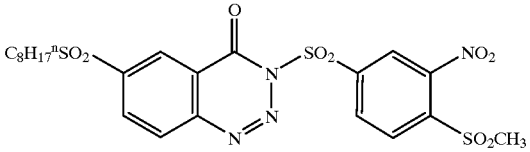
A-33
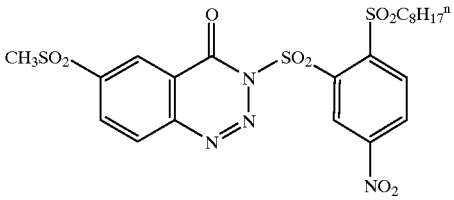
A-34
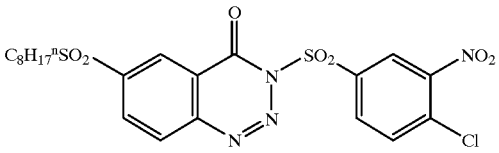
A-35
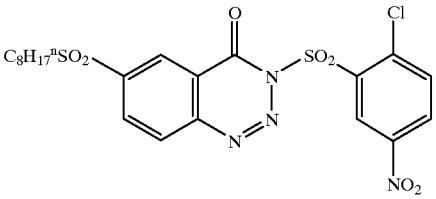
A-36

-continued

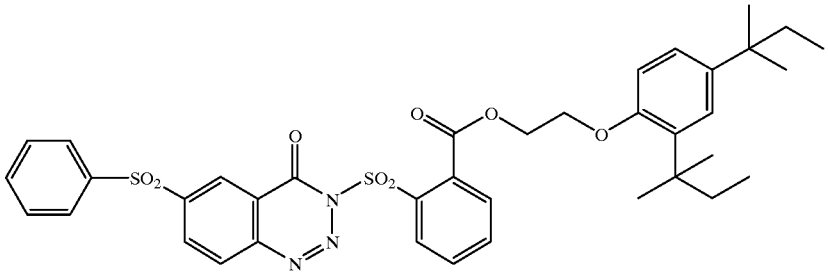

A-37

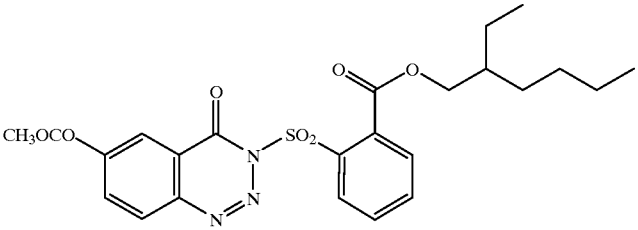

A-38

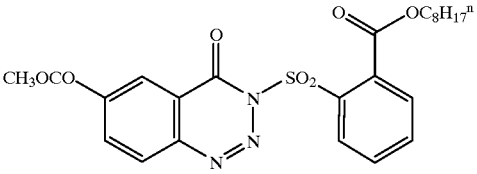

A-39

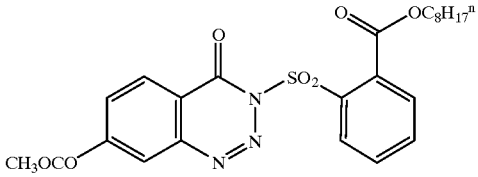

A-40

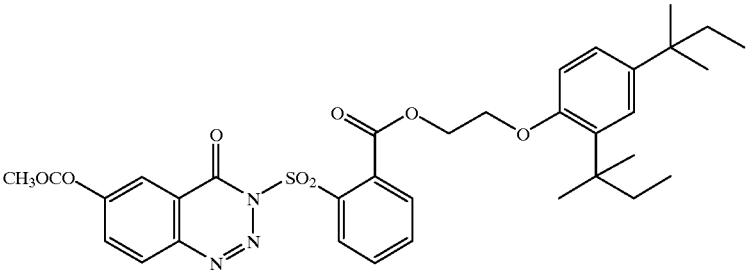

A-41

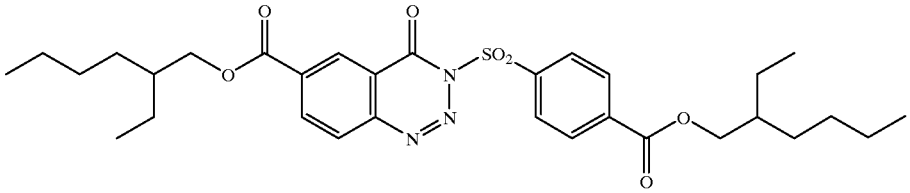

A-42

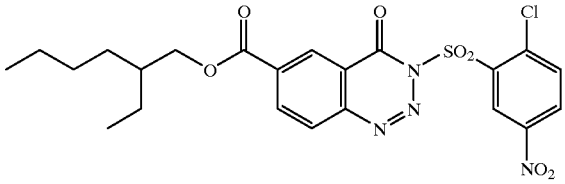

The diazo compounds represented by aforementioned general formulas (I) to (III) can be prepared by using known synthesizing method disclosed, for example, in Japanese Patent Application Laid-Open (JP-A) No. 9-28678. The diazo compounds represented by aforementioned general formulas (I) to (III) can be respectively prepared by, for example, diazotization followed by cyclization of the compound represented by the following general formulas (VI), (VII) and (VIII). Alternatively, the diazo compounds represented by aforementioned general formulas (I) to (III) can also be respectively prepared by reacting each of triazines represented by the following general formulas (IX) and (X)

with the compound represented by general formula (XI) in the presence of base.

In general formula (XI), X represents a halogen atom.

general formula (VI)

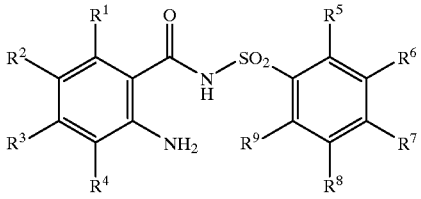

general formula (VII)

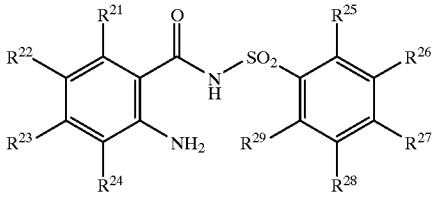

general formula (VIII)

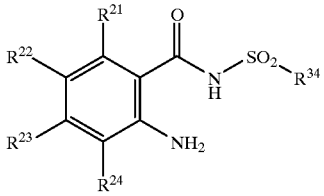

general formula (IX)

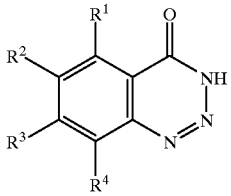

general formula (X)

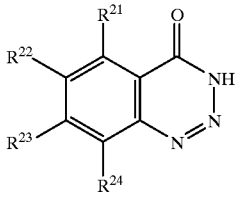

general formula (XI)

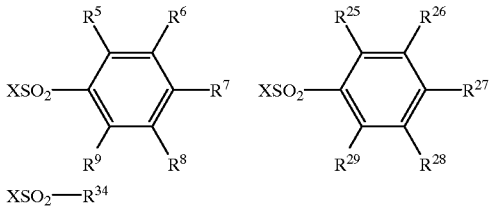

In the specification, an "diazo compound" is indicated by the diazo compound defined in "Diazo Chemistry I Aromatic and Heteroaromatic compounds" (Heinrich Zollinger, VCH Verlagsgesellschaft, Weinmheim, 1994).

4. Heat-sensitive Recording Material

The heat-sensitive recording material of the present invention is a heat-sensitive recording material in which a heat-sensitive recording layer containing at least a diazo compound which is represented by any one of the aforementioned general formulas (I) to (III) and a coupler to react with the diazo compound to color the same is provided on a substrate. A single diazo compound represented by any one of the aforementioned general formulas (I) to (III) or a combination of two or more compounds may be used.

The compounds shown by general formulas (I) to (III) may be oily materials or in a crystal state but the crystal state is preferable because of its handling properties.

The amount of the diazo compound in the heat-sensitive recording layer is preferably from 0.02 to 5 g/m$^2$ of the heat-sensitive recording layer, and particularly preferably from 0.1 to 4 g/m$^2$ in view of the density of color-development As the coupler used in the present invention, any kind of coupler which reacts with the above-described diazo compound to color the same (i.e., to form a dye) can be used. All types of so-called four-equivalent couplers for silver halide photographic photosensitive materials can be used as the coupler. The coupler for the present invention can be selected from known couplers according to the desired hue. Examples thereof include so-called active methylene compounds having a methylene group next to the carbonyl group, phenol derivatives, naphthol derivatives and the like.

Specific examples of the coupler include resorcin, phloroglucin, 2,3-dihydroxynaphthalene-6-sodium sulfonate, 2-hydroxy-3-naphthalene sodium sulfonate, 2-hydroxy-3-naphthalenesulfonic anilide, 1-hydroxy-2-naphthoic morpholinopropylamide, 2-hydroxy-3- naphthalenesulfonic morpholinopropylamide, 2-hydroxy-3-naphthalenesulfonic-2-ethylhexyloxypropylamide, 2-hydroxy-3-naphthalenesulfonic-2-ethylhexylarnide, 5-acetoamide-1-naphthol, 1-hydroxy-8-acetoamidenaphthalene-3,6-sodium disulfonate, 1-hydroxy-8-acetoamidenaphthalene-3,6-disulfonic dianilide, 1,5-dihydroxynaphthalene, 2,3-dihydroxynaphthalene, 2-hydroxy-3-naphthoic morpholinopropylamide, 2-hydroxy-3-naphthoic octylamide, 2-hydroxy-3-naphthoic anilide, 5,5-dimethyl-1,3-cyclohexanedione, 1,3-cyclopentanedione, 5-(2-n-tetradecyloxyphenyl)-1,3cyclohexanedione, 5-phenyl-4-methoxycarbonyl-1,3-cyclohexanedione, 5-(2,5-di-n-octyloxyphenyl)-1,3-cycdohexanedione, 1,3-dicyclohexylbarbituric acid, 1,3-di-n-dodecylbarbituric acid, 1-n-octyl-3-n-octadecylbarbituric acid, 1-phenyl-3-(2,5-di-n-octyloxyphenyl) barbituric acid, 1,3-bis (octadecyloxycarbonylmethyl) barbituric acid, 1-phenyl-3-methyl-5-pyrazolone, 1-(2,4,6-trichlorophenyl)-3-anilino-5-pyrazolone, 1-(2,4,6-trichlorophenyl)-3-benzamide-5-pyrazolone, 6-hydroxy-4-methyl-3-cyano-1-(2-ethylhexyl)-2-pyridone, 2-[3-[α-(2,4-di-tert-aluminum phenoxy) butaneamide] benzamide] phenol, 2,4-bis-(benzoylacetoamino) toluene, 1,3-bis-(pivaloylacetoaminnomethyl) benzene, benzoylacetonitrile, thenoylacetonitrile, acetoacetoanilide, benzoylacetoanilide, pivaloylacetoanilide, 2-chloro-5-(N-n-butylsulfamoyl)-1-pivaloylacetoamidebenzene, 1-(2-ethylhexyloxypropyl)-3-cyano-4-methyl-6-hydroxy-1,2-dihydropyridine-2-one, 1-(dodecyloxypropyl)-3-acetyl4-methyl-6-hydroxy-1,2-dihydropyridine-2-one, and 1-(4-n-octyloxyphenyl)-3-tert-butyl-5-aminopyrazole. Details of the couplers are described in Japanese Patent Application Laid-Open (JP-A) Nos. 4-201483; 7-125446; 7-96671; 7-223367; 7-223368; etc.

A compound represented by the following general formula (IV) or a resonance isomer of the compound is preferably used as a coupler.

general formula (IV)

$$E^1—CH_2—E^2$$

In general formula (IV), electron attractive groups represented by $E^1$ and $E^2$ are substituents which have a positive Hamett sigma(σ) constant, and these substituents may be identical or different Preferable examples thereof include acyl groups such as an acetyl group, a propionyl group, a pivaloyl group, a chloroacetyl group, a trifluoroacetyl group, a 1-methylcyclopropylcarbonyl group, a 1-ethylcyclopropylcarbonyl group, a 1-benzylcyclopropylcarbonyl group, a benzoyl group, a 4-methoxybenzoyl group and a thenoyl group, oxycarbonyl groups such as a methoxycarbonyl group, an ethoxycarbonyl group, a 2-methoxyethoxycarbonyl group and a 4-methoxyphenoxycarbonyl group, carbamoyl groups such as a carbamoyl group, an N—N-dimethylcarbamoyl group, an N—N-diethylcarbamoyl group, an N-phenylcarbamoyl group, an N-2,4-bis(pentyloxy)phenylcarbamoyl group, an N-2,4-bis(octyloxy)phenylcarbamoyl group and a morpholinocarbonyl group, a cyano group, sulfonyl groups such as a methanesulfonyl group, a benzenesulfonyl group, a toluenesulfonyl group, phosphono groups such as a diethylphosphono group, heterocyclic groups such as a benzoxazole-2-yl group, a benzothiazole-2-yl group, a 3,4-dihydroquinazoline4-one-2-yl group and a 3,4-dihydroquinazoline4-sulfone-2-yl group, and the like.

$E^1$ and $E^2$ may be combined with each other to form a ring. A ring formed by $E^1$ and $E^2$ is preferably a 5- or 6-membered carbon ring or a heterocyclic ring.

Specific examples of the compound shown by the formula (IV) are illustrated below but the coupler used in the present invention is not limited to these compounds.

C-1

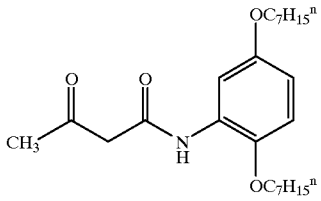

C-2

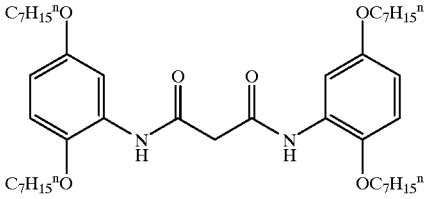

C-3

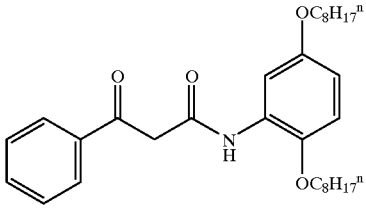

-continued

C-4

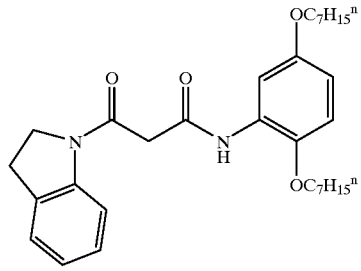

C-5

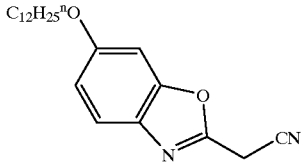

C-6

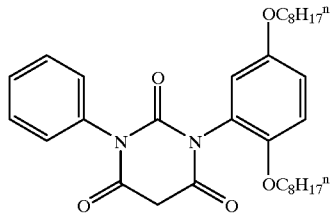

C-7

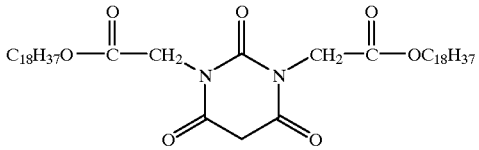

C-8

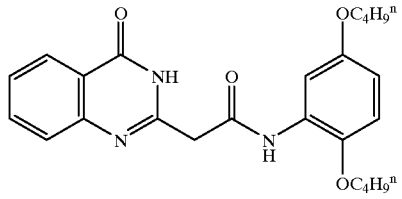

C-9

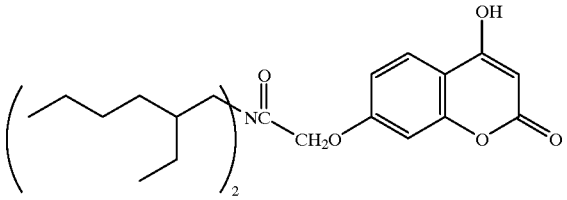

C-10

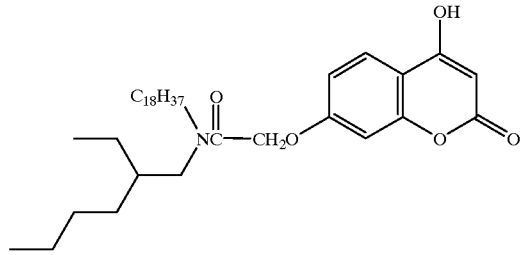

-continued
C-11
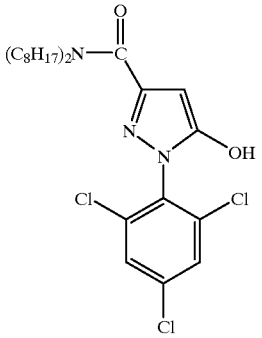
C-12
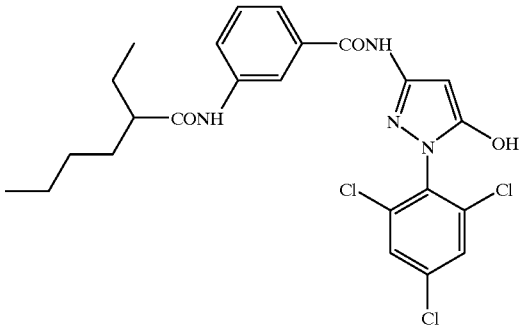
C-13
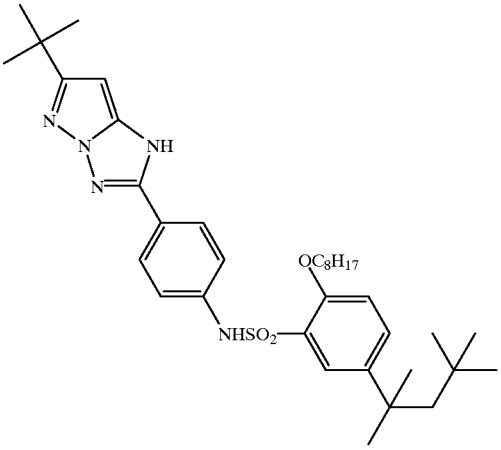
C-14
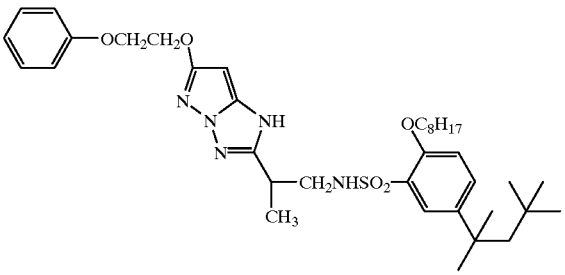
-continued
C-15
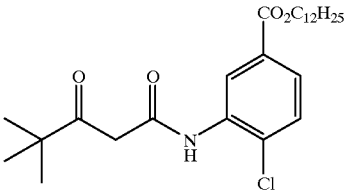
C-16
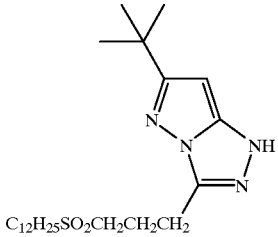
C-17
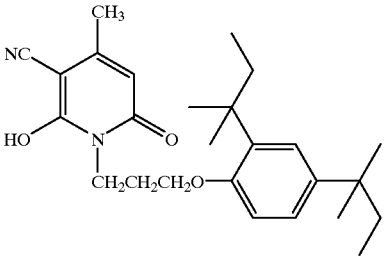
C-18
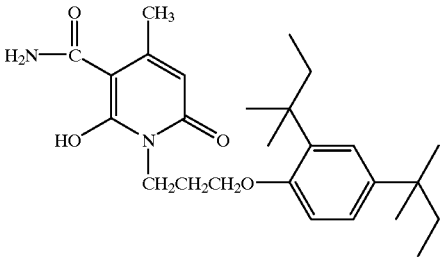
C-19
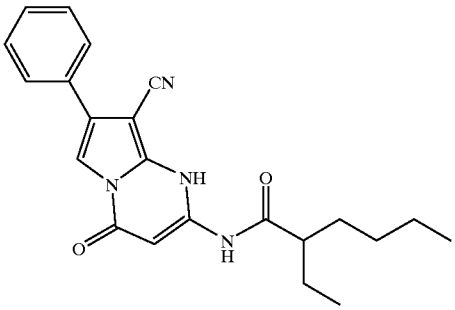

-continued

C-20

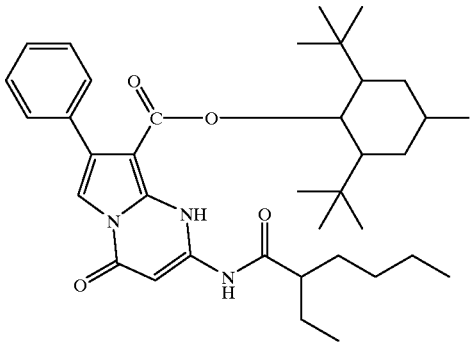

C-21

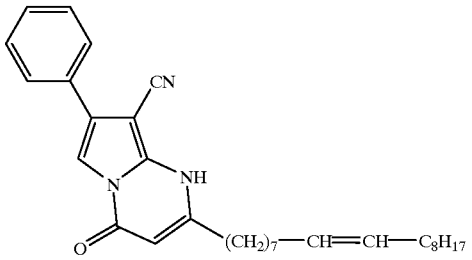

C-22

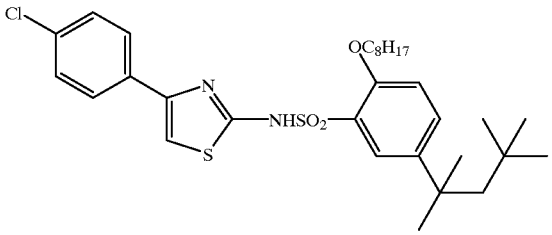

C-23

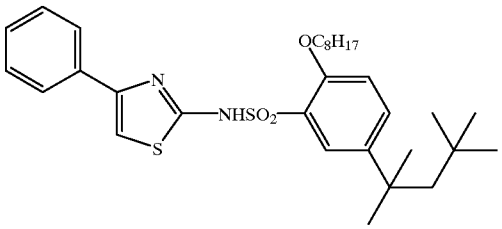

C-24

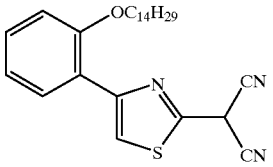

In the heat-sensitive recording material of the present invention, an organic base may be added in order to accelerate the coupling reaction between the diazo compound and the coupler. It is preferable that the organic base is included in a heat-sensitive recording layer together with a diazo compound and a coupler. A single organic base or a combination of two or more types of organic base may be used. Examples of the organic bases include nitrogen-containing compounds such as tertiary amines, piperidines, piperazines, amidines, formamidines, pyridines, guanidines, morpholines, and the like. Also, the organic bases described in Japanese Patent Publication UP-B) No. 52-46806; Japanese Patent Application Laid-Open Up-A) Nos. 62-70082; 57-169745; 60-94381; 57-123086; 58-1347901; 60-49991; JP-B Nos. 2-24916; 2-28479; JP-A Nos. 60-165288 and 57-185430 can be used.

Of these compounds, piperazines such as N,N'-bis(3-phenoxy-2-hydroxypropyl)piperazine, N,N'-bis[3-(p-methylphenoxy)-2-hydroxypropyl]piperazine, N,N'-bis[3-(p-methoxyphenoxy)-2-hydroxypropyl]piperazine, N,N'-bis(3-phenylthio-2-hydroxypropyl)piperazine, N,N'-bis[(3-(β-naphthoxy)-2-hydroxypropyl]piperazine, N-3-(β-naphthoxy)-2-hydroxypropyl-N'-methylpiperazine and 1,4-bis{[3-(N-methylpiperazino)-2-hydroxy]propyloxy}benzene, morpholines such as N-[3-(β-naphthoxy)-2-hydroxy]propylmorpholine, 1,4-bis(3-morpholino-2-hydroxy-propyloxy)benzene and 1,3-bis(3-morpholino-2-hydroxy-propyloxy)benzene, piperidines such as N-(3-phenoxy-2-hydroxypropyl)piperidine and N-dodecylpiperidine, and guanidines such as triphenylguanidine, tricyclohexylguanidine and dicyclohexylphenylguanidine, etc. are preferable.

It is preferable that the coupler is present in the heat-sensitive recording layer in an amount of 0.1 to 30 parts by weight for one part by weight of the diazo compound. Moreover, when an organic base has been optionally included, it is preferable that the organic base is present in an amount of 0.1 to 30 parts by weight for one part by weight of the diazo compound.

In the heat-sensitive recording materials of the present invention, in addition to the above-described organic base, a color-developing assistant can be added for the purpose of accelerating the color formation reaction. The color-developing assistant is a material that increases the density of formed color on thermal recording or lowers the minimum color-developing temperature and makes the diazo compound, the organic base, the coupler, etc. more easily react by lowering the melting points of the coupler, the organic base, or the diazo compound, etc., and by lowering the softening point of the walls of the capsules.

The examples of the color-developing assistant used in the present invention include phenol derivatives, naphthol derivatives, alkoxy-substituted benzenes, alkoxy-substituted naphthalenes, aromatic ether, thioether, ester, amide, ureide, urethane, sulfonamide compounds or hydroxy compounds, etc., which are added in the color formation layers such that the thermal printing can be carried out quickly and completely at low energy expenditure.

In the heat-sensitive recording materials of the present invention, it is preferable to use the known antioxidants, etc., shown below for the purpose of improving the color fastness of the thermally color-developed images to light and heat or reducing yellowing of the unprinted portions through exposure to light after fixing.

The above-described antioxidants are described, for example, in European Patent Application (EP-A) Nos. 223739; 309401; 309402; 310551; 310552; and 459416; German Patent Application (DE-A) No. 3,435,443; Japanese Patent Application Laid-Open (JP-A) Nos. 5448535; 62-262047; 63-113536; 63-163351; 2-262654; 2-71262; 3-121449; 5-61166; and 5-119449; and U.S. Pat. Nos. 4,814,262; and 4,980,275; etc.

In the present invention, it is effective to further use various kinds of known additives already used for conventional heat-sensitive recording materials and pressure-sensitive recording materials. Practical examples of these various kinds of additives are described in Japanese Patent Application Laid-Open (JP-A) Nos. 60-107384; 60-107383; 60-125470; 60-125471; 60-125472; 60-287485; 60-287486;

60-287487; 60-287488; 61-160287; 61-185483; 61-211079; 62-146678; 62-146680; 62-146679; 62-282885; 63-051174; 63-89877; 63-88380; 63-088381; 63-203372; 63-224989; 63-251282; 63-267594; 63-182484; 1-239282; 4-291685; 4-291684; 5-188687; 5-188686; 5-110490; 5-1108437; and 5-170361; Japanese Patent Publication (JP-B) Nos. 48-043294 and 48-033212; etc.

Specifically, examples thereof include 6-ethoxy-1-phenyl-2,2,4-trimethyl-1,2-dihydroquinoline, 6-ethoxy-1-octyl-2,2,4-trimethyl-1,2-dihydroquinoline, 6-ethoxy-1-phenyl-2,2,4-trimethyl-1,2,3,4-tetrahydroquinoline, 6-ethoxy-1-octyl-2,2,4-trimethyl-1,2,3,4-tetrahydroquinoline, nickel cyclohexanoate, 2,2-bis(4-hydroxyphenyl)propane, 1,1-bis(4-hydroxyphenyl)-2-ethylhexane, 2-methyl-4-methoxy-diphenylamine, 1-methyl-2-phenylindole, and the like.

It is preferable that these anoxidants and various additives are present m an amount of 0.05 to 100 parts by weight and particularly from 0.2 to 30 parts by weight for one part by weight of the diazo compound.

These known anoxidants and various additives can be encapsulated together with the diazo compound and used in microcapsules, or can be used as a solid dispersion together with the coupler, the organic base, and others, such as a color-developing assistant, etc., or as an emulsion with an appropriate emulsification assistant, or can be used in both forms. A single antioxidant and a single additive or a combination of two or more types of such antioxidants and various additives may be used. Also, the antioxidant can be added to a protective layer formed on the heat-sensitive recording layer.

These antioxidants and various kinds of additives need not always be added to the same layer. Furthermore, when a plurality of these antioxidants and various kinds of additives are used as a combination, they may be classified according to structure, for example, into anilines, alkoxybenzenes, hindered phenols, hindered amines, hydroquinone derivatives, phosphorus compounds, sulfur compounds, and antioxidants having different structures may be combined or antioxidants having the same structure can be combined.

In the heat-sensitive recording material of the present invention, a free radical generating agent (i.e., a compound generating a free radical when irradiated by light), which is used for photopolymerization compositions, etc., can be added for the purpose of reducing yellow discoloring of the ground portion after recording. The free radical generating agent includes aromatic ketones, quinones, benzoin, benzoin ethers, diazo compounds, organic disulfides, acyloxim esters, etc. The amount added of the radical generating agent is preferably from 0.01 to 5 parts by weight for one part by weight of the diazo compound.

Also, similarly, for the purpose of reducing yellow discoloring, a polymerizable compound having an ethylenic unsaturated bonding (hereinafter, referred to as a vinyl monomer) can be used for the heat-sensitive recording material of the present invention. A vinyl monomer is a compound having at least one ethylenic unsaturated bonding (a vinyl group, a vinylidene group, etc.) in the chemical structure and has a monomer or prepolymer chemical form. Examples thereof include unsaturated carboxylic acids or the salts thereof, the esters of unsaturated carboxylic acids and aliphatic polyhydric alcohols, and the amides of unsaturated carboxylic acids and aliphatic polyhydric amines. The vinyl monomer is used in an amount of 0.2 to 20 parts by weight for one part by weight of the diazo compound.

The above-described free radical generating agent and vinyl monomer can be encapsulated together with the diazo compound and used in microcapsules.

In the present invention, in addition to the above-described materials, citric acid, tartaric acid, oxalic acid, boric acid, phosphoric acid, pyrophosphoric acid, etc., can be added as an acid stabilizer.

As the binder used for the heat-sensitive recording layer, known water-soluble polymers, or latexes, etc., can be used. The water-soluble polymers which can be used as a binder include methyl cellulose, carboxymethyl cellulose, hydroxyethyl cellulose, hydroxypropyl cellulose, starch derivatives, casein, gum arabic, gelatin, an ethylene-maleic anhydride copolymer, a styrene-maleic anhydride copolymer, polyvinyl alcohol, epichlorohydrin-modified polyamide, an isobutylene-maleic anhydride-salicylic acid copolymer, polyacrylic acid, polyacrylic amide, etc., and the modified products thereof. Also, the latexes include a styrene-butadiene rubber latex, a methyl acrylate-butadiene rubber latex, a vinyl acetate emulsion, and the like.

In the heat-sensitive recording material of the present invention, pigments can be present in the heat-sensitive recording layer or in other layers. As pigments, known pigments such as organic pigments and inorganic pigments can be used. Examples thereof include kaolin, calcined kaolin, talc, agalmatolite, diatomaceous earth, calcium carbonate, aluminum hydroxide, magnesium hydroxide, zinc oxide, lithopone, amorphous silica, colloidal silica, calcined gypsum, silica, magnesium carbonate, titanium oxide, alumina, barium carbonate, barium sulfate, mica, microballoon, a urea-formalin filler, polyester particles, a cellulose filler, and the like.

In the heat-sensitive recording materials of the present invention, various kinds of additives such as known waxes, antistatic agents, antifoaming agents, electrically conductive agents, fluorescent dyes, surface active agents, UV absorbers and the precursors thereof, etc., can be optionally used in the heat-sensitive recording layer or in other layers.

In the heat-sensitive recording layer, it is preferable to encapsulate the diazo compound in microcapsules in order to improve storability of the heat-sensitive recording materials before use. Known methods can be used for forming a microcapsule. It is preferable that the microcapsule is formed from a polymer which shows material impermeability at room temperature but shows a material permeability upon heating. In particular, a polymer having a glass transition temperature in the range of from 60 to 200° C. is preferably used. Examples thereof include a polyurethane, polyurea, polyamide, polyester, urea-formaldehyde resin, melamine resin, polystyrene, styrene-methacrylate copolymer, styrene-acrylate copolymer, and mixtures thereof. It is particularly preferable that the microcapsules are formed from polymers which consist of urethane and/or urea (examples of such polymers include polyurethane, polyurea, etc.).

As a formation method of microcapsules in the present invention, it is suitable to employ an interfacial polymerization method and an internal polymerization method. The details of the formation method of microcapsules and the practical examples of the reactants are described in U.S. Pat. Nos. 3,726,804; 3,796,669; etc. For example, when polyurea or polyurethane is used as a capsule wall material, polyisocyanate and a second substance (for example, polyol and polyamine) forming capsule walls by reacting with the polyisocyanate are mixed in an aqueous medium or an oily medium to be encapsulated. They are emulsified in water, and then heated, whereby a polymerization reaction occurs at the interface between the oil phase and the aqueous phase to form walls of microcapsules. When the addition of the above-described second substance is omitted, polyurea is formed.

An example of the production method of the diazo compound-containing microcapsules (polyurea-polyurethane walls) in the present invention is explained below.

First, the diazo compound is dissolved or dispersed in a hydrophobic organic solvent which becomes the capsule core. As the organic solvent in this case, an organic solvent having a boiling point of from 100 to 300° C. is preferable. Into the core solvent is further added a polyvalent isocyanate as the wall material (oil phase).

On the other hand, as the aqueous phase, an aqueous solution in which a water-soluble polymer such as polyvinyl alcohol, gelatin, etc. has been dissolved is prepared. Then, after adding thereto the above-described oil phase, they are emulsified and dispersed by a means such as a homogenizer, etc. In this case, the water-soluble polymer functions as a stabilizer for the emulsification and dispersion. To carry out the emulsification and dispersion more stably, a surface active agent may be added to at least one of the oil phase and the aqueous phase.

The amount of the polyvalent isocyanate to be used is determined such that the mean particle size of the microcapsules is from 0.3 to 12 $\mu$m and the wall thickness is from 0.01 to 0.3 $\mu$m. The dispersed particle sizes are generally from about 0.2 to 10 $\mu$m. In the emulsified dispersion, the polymerization reaction of the polyvalent isocyanate occurs at the interface of the oil phase and the aqueous phase to form polyurea walls.

When polyol is added in advance into the aqueous phase, the polyvalent isocyanate reacts with the polyol, whereby polyurethane walls can be formed. To accelerate the reaction rate, it is preferable to keep the reaction temperature high or to add a suitable polymerization catalyst The polyvalent isocyanates, polyols, reaction catalysts, and polyamines for forming a part of walls of microcapsules, etc., are described in detail, for example, in Keiji Iwata, "Polyurethane Handbook", published by Nikkan Kogyo Shinbun-sha, 1987.

As the polyvalent isocyanate compound used as the raw material for the walls of microcapsules, a compound having a three or more isocyanate group is preferable but a diisocyanate compound may also be used. Examples thereof include: diisocyanate compounds such as xylene diisocyanate or the hydrogenated product thereof, hexamethylene diisocyanate, tolylene diisocyanate or the hydrogenated product thereof, and isophorone diisocyanate as the main raw material; the dimers or trimers (biulets or isocyanurates) of sucn diiaocyanate compounds; the polyfunctional isocyanate compounds obtained as the adducts of a polyol such as trimethylolpropane, and a difunctional isocyanate such as xylylene diisocyanate etc.; a compound in which the high-molecular weight compound such as polyether having active hydrogen (e.g., polyethyleneoxide) is introduced into the adducts of a polyol such as timethylolpropane, and difunctional isocyanate such as xylylene diisocyanate; a compound in which the high-molecular weight compound such as polyether having an active hydrogen (e.g., polyethyleneoxide) is introduced into the adducts of a polyol such as trimethylolpropane, and a difunctional isocyanate such as xylylene diisocyanate; formalin condensate of benzene isocyanate; and the like. The compounds described in Japanese Patent Application Laid-Open (JP-A) Nos. 62-212190; 4-26189; 5-317694; 8-268721; etc. are preferably used.

Furthermore, a polyol or a polyamine may be added to the hydrophobic solvent which becomes the cores of microcapsules or to a water-soluble macro molecular compound solution which becomes a disperse medium whereby it can be used as one of the raw materials for the walls of microcapsules. Specific examples of these polyols or polyamines include propylene glycol, glycerin, trimethylolpropane, triethanolamine, sorbitol, and ihexamethylenediamine, and the like. When a polyol is added, ipolyurethane walls are formed.

As the hydrophobic organic solvent in the case of dissolving the diazo compound and forming the cores of microcapsules described above, an organic solvent having a boiling point of from 100 to 300° C. is preferable. Examples thereof include an alkyl naphthalene, an alkyl diphenylethane, an alkyl diphenylmethane, an alkyl biphenyl, an alkyl terphenyl, chlorinated paraffin, phosphoric esters, maleic acid esters, adipic acid esters, phthalic acid esters, benzoic acid esters, carbonic acid esters, ethers, sulfuric acid esters, and sulfonic acid esters, and the like. A single organic solvent or two or more types of such organic solvents may be used.

When the solubility of the diazo compound to be encapsulated in these solvents is low, a low-boiling point solvent in which the diazo compound used shows a high solubility may secondarily used. Specific examples of the low-boiling point solvent include ethyl acetate, butyl acetate, methylene chloride, tetrahydrofuran, acetonitrile, and acetone. Therefore, it is preferable that the diazo compound has a proper solubility in the high-boiling point hydrohobic organic solvent or in the low-boiling auxiliary solvent In particular, it is preferable that the diazo compound has a solubility of at least 5 wt % in such solvents and a solubility of 1% or less in water.

As the water-soluble polymer used for the water-soluble polymer solution for dispersing the oil phase of microcapsules thus prepared, a water-soluble polymer having a solubility of at least 5 wt % in water at a temperature at which the system is emulsified is preferable. Practical examples thereof include polyvinyl alcohol and the modified products thereof, polyacrylic amide and the derivatives thereof, an ethylene-vinyl acetate copolymer, a styrene-maleic anhydride copolymer, an ethylene-maleic anhydride copolymer, an isobutylene-maleic anhydride copolymer, polyvinyl pyrrolidone, an ethylene-acrylic acid copolymer, a vinyl acetate-acrylic acid copolymer, carboxymethyl cellulose, methyl cellulose, casein, gelatin, starch derivatives, gum arabic, and sodium alginate.

It is preferable that these water-soluble polymers have no or low reactivity with an isocyanate compound and, for example, in the case of using a water-soluble polymer having a reactive amino group in the molecule chain, such as gelatin, it is necessary to get rid of the reactivity by, for example, previously modifying the polymer.

Also, in the case of adding a surface active agent, the amount of the surface active agent to be added is preferably from 0.1% to 5%, and particularly preferably from 0.5% to 2% of the weight of the oil phase.

For the emulsification, a known emulsifying means such as a homogenizer, a Manton-Gaulin, an ultrasonic disperser, a dissolver, a KD mill, etc., can be used. After the emulsification, the emulsified product is heated to a temperature of from 30 to 70° C. to accelerate the microcapsule wall forming reaction. To prevent the flocculation of microcapsules with each other during the reaction, it is necessary to lower the possibility of collision of the microcapsules with each other by adding water or by stirring well.

Also, during the reaction, a dispersant may be added to prevent flocculation. With the progress of the polymerization reaction, the generation of carbon dioxide is observed and with the cessation of the generation of the gas, the capsule wall formation reaction can be considered to be finished. Usually, by reacting for several hours, the desired diazo compound-containing microcapsules can be obtained.

The coupler used in the present invention can optionally be used together with the water-soluble polymer by solid-dispersing with a sand mill, etc. An organic base, and others such as a color-developing assistant, etc., can also be added here. However, it is preferable that after dissolving the coupler in an organic solvent which is hardly soluble or insoluble in water, the solution is mixed with an aqueous phase containing a surface active agent and/or the water-soluble polymer as a protective colloid to form an emulsified dispersion. From the view point of facilitating emulsification and dispersion, it is preferable to use a surface active agent The organic solvent used in this case can be suitably selected from the oils having a high-boiling point described, for example, in Japanese Patent Application Laid-Open (JP-A) No. 2-141279.

Of these high-boiling point oils, from the view point of the emulsification stability of the emulsified products, the use of esters is preferable and in particular, the use of tricresyl phosphate is preferable.

These oils can be combined or even used with other oils.

To the above-described organic solvent can be further added an auxiliary solvent as a low-boiling point dissolution assistant As such an auxiliary solvent, for example, ethyl acetate, isopropyl acetate, butyl acetate and methylene chloride are particularly preferable. In some cases, only a low-boiling point auxiliary solvent may be used without adding any high-boiling point oil.

The water-soluble polymer which is added as a protective colloid to the aqueous phase mixed with the oil phase containing these components can be suitably selected from known anionic polymers, nonionic polymers, and amphoteric polymers. The preferable water-soluble polymers include, for example, polyvinyl alcohol, gelatin, and cellulose derivatives.

Also, the surface active agent which may be incorporated in the aqueous phase is optionally selected from anionic or nonionic surface active agents which do not cause precipitation or flocculation by acting with the above-described protective colloid. Preferred surface active agents include a sodium alkylbenzene sulfonate, a sodium alkyl sulfate, a sodium dioctyl sulfosuccinate, a polyalkylene glycol (for example, polyoxyethylene nonylphenyl ether), and the like.

For the heat-sensitive recording material of the present invention, it is preferable that a coating solution containing the diazo compound-containing microcapsules, the coupler, and optionally, the organic base and other additive(s) is prepared and coated onto a substrate such as paper, a synthetic resin film, etc., by a coating method such as bar coating, blade coating, air-knife coating, gravure coating, roll coating, spray coating, dip coating, curtain coating, etc., followed by drying to form a heat-sensitive layer containing solid components of from 2.5 to 30 g/m$^2$.

In the heat-sensitive recording material of the present invention, the microcapsules, the coupler, the organic base, etc., may exist in the same layer but a laminated layer-type structure wherein the above-described components exist in different layers may be employed. Also, after forming on a substrate an intermediate layer such as described in Japanese Patent Application No. 59-177669, the heat-sensitive layer or layers can be coated thereon.

In the heat-sensitive recording material of the present invention, a protective layer may optionally be formed on the heat-sensitive recording layer. The protective layer may be, if necessary, a laminate of two or more layers. As the material used for the protective layer, water-soluble high-molecular compounds such as polyvinyl alcohol, carboxy-modified polyvinyl alcohol, a vinyl acetate-acrylamide copolymer, silicon-modified polyvinyl alcohol, starch, denatured starch, methyl cellulose, carboxymethyl cellulose, hydroxymethyl cellulose, gelatins, gum arabic, casein, a styrene-maleic copolymer hydrolysate, a styrene-maleic copolymer half ester hydrolysate, an isobutylene-maleic anhydride copolymer hydrolysate, polyacrylamide derivatives, polyvinyl pyrrolidone, sodium polystyrenesulfonate, sodium alginate, etc.; and latexes such as a styrene-butadiene rubber latex, an acrylonitrile-butadiene rubber latex, a methyl acrylate-butadiene rubber latex, a vinyl acetate emulsion, etc., are used. By crosslinking the water-soluble polymer in the protective layer, the storage stability of the heat-sensitive recording material can be further improved. As the crosslinking agent, a known crosslinking agent can be used. Specific examples thereof include water-soluble initial condensates such as N-methylolurea, N-methylolmelamine, urea-formalin, etc.; dialdehyde compounds such as glyoxal, glutaraldehyde, etc.; inorganic crosslinking agents such as boric acid, borax, etc.; and polyamide epichlorohydrin, and the like. Furthermore, the protective layer may include known pigments, metallic soaps, waxes, surface active agents, UV absorber, and the precursors thereof, etc.

The protective layer can be formed by preparing a coating solution containing aforementioned components, applying and drying the same. The coating amount of the coating solution for the protective layer is preferably from 0.2 to 5 g/m$^2$, and more preferably from 0.5 to 2 g/m$^2$. Also, the thickness of the protective layer is preferably from 0.2 to 5 $\mu$m, and particularly preferably from 0.5 to 2 $\mu$m.

As the substrate used for the heat-sensitive recording material of the present invention, paper substrates used for conventional pressure-sensitive paper, thermal recording paper, dry-type or wet-type diazo-type paper, etc., can be used. Moreover, acid paper, neutralized paper, coated paper, plastic film-laminated paper, synthetic paper, and plastic films, etc., can also be used.

Also, in the heat-sensitive recording material of the present invention, to correct the curl balance of the substrate or to improve the chemical resistance of the back surface of the substrate, a backcoat layer can be formed in the same manner as the above-described protective layer. Furthermore, it is possible to form a label by providing a releasing paper at the back surface of the substrate via an adhesive layer.

EXAMPLES

The following examples further illustrate the present invention, but do not limit the scope thereof. In the examples, "parts" and "%" are respectively "parts by weight", and "% by weight".

Synthesis of the titled compound A-23

9.6 g of 6-nitro-3,4-dihydrobenzo[e]-triazine-4-one, 20.0 g of 3-(2-ethylhexyloxycarbonyl) benzenesulfonyl chloride and 50 ml of acetonitrile were mixed and the resulting mixture was cooled to 5° C. to prepare a reaction mother solution. Then, to the mother solution was slowly (for 20 minutes) added dropwise 5.1 g of triethylamine to accelerate reaction. Further, the reaction solution was stirred for 10 minutes, and after the reaction solution was mixed until it became uniform, 150 ml of water was added thereto. 200 ml of ethyl acetate was added to the reaction solution and the product liquid was extracted. The extracted liquid was washed with a sodium chloride solution, and dried over magnesium sulfate. Further, the extracted liquid was filtered and condensed under a reduced pressure, to obtain a gross product of the titled compound A-23. This product was purified by silica gel chromatography, to obtain colorless liquid of the compound A-23 (the yield was 17.7 g). The structure of the compound is determined by measuring NMR.

1H-NMR (CDC13): 9.10 ppm (S, 1H), 8.9 ppm (S, 1H), 8.78 ppm (d, 8 Hz, 1H), 8.58–8.38 ppm (m. 3H), 7.76 ppm (t, 8 Hz, 1H), 4.32 ppm (d, 6 Hz, 2H), 1.77 ppm (m, 1H), 1.53–1.14 ppm (m, 8H), 0.84–1.02 ppm (m, 6H).

Preparation and evaluation of a heat-sensitive recording material

Example 1

(Preparation of diazo compound-containing microcapsule solution A)

To 13.7 parts of ethyl acetate were added 4.6 parts of the diazo compound (the titled Compound A-1) and 10.4 parts of phthalic acid diphenylester as core materials and the solution was uniformly mixed. Then, to the mixed solution was added 5.5 parts of "Takenate D110N" (trade name, made by Takeda Chemical Industries, Inc.) and 2.8 parts of "Millonate MR200" (trade name, made by Nippon Polyurethane Industries, Inc.) as wall materials to obtain a solution X. Then, the above-described solution X was added to a mixed solution of 62.7 parts of an aqueous solution of 8% phthalated gelatin, 17.4 parts of water, and 0.4 parts of SucraphA G-8 (Nippon Seika Inc.) and the mixture was emulsified and dispersed using a homogenizer for 10 minutes at 40° C. and 8,000 rpm. After adding 50 parts of water and 0.26 parts of diethylenetriamine to the emulsion and mixing the solution until it became uniform, a microencapsulation reaction was carried out with stirring for 3 hours at 60° C. to provide a diazo compound-containing microcapsule solution A. The mean particle size of the microcapsules was from 0.3 to 0.4 $\mu$m.

(Preparation of coupler emulsion B)

In 12.5 parts of ethyl acetate were dissolved 3.5 parts of the coupler (the titled Compound C-11), 1.9 parts of triphenylguanidine, and 3.3 parts of tricresyl phosphate, to obtain a solution Y. Then, the solution Y was added to an aqueous solution prepared by uniformly mixing 50 parts of an aqueous solution of 15% lime-processed gelatin, 0.5 parts of an aqueous solution of 10% sodium dodecylbenzenesulfonate, and 50 parts of water at 40° C., and the mixture was emulsified and dispersed using a homogenizer for 10 minutes at 40° C. and 10,000 rpm. After stirring the emulsion obtained for 2 hours at 40° C. to remove ethyl acetate, water was added to the emulsion to provide a coupler emulsion B. (Preparation of heat-sensitive recording layer coating solution C)

By mixing 10 parts of the diazo compound-containing microcapsule solution A and 30 parts of the coupler emulsion B, a heat-sensitive recording layer coating solution C was obtained.

(Preparation of protective layer coating solution D)

By uniformly mixing 32 parts of an aqueous solution of 10% polyvinyl alcohol (polymerization degree: 1,700, saponification degree: 88%) and 16 parts of water, a protective layer coating solution D was obtained.

(Coating)

After coating with a wire bar the heat-sensitive recording layer coating solution C and, thereover the protective layer coating solution D on a substrate for photographic paper obtained by laminating polyethylene on wood-free paper, the product was dried at 50° C. to obtain the desired heat-sensitive recording material. The coating amounts of the heat-sensitive recording layer and the protective layer as solid components were 3.5 g/m$^2$ and 1.2 g/m$^2$, respectively.

Example 2 to Example 6

Heat-sensitive recording materials of Examples 2 to 6 were prepared in the same manner as in example 1, except that compounds shown in the following Table 1 were used respectively instead of the diazo compound and the coupler used in Example 1.

Comparative Example 1

An attempt was made to prepare a diazo compound-containing microcapsule solution in the same manner as in Example 1, except that the compound represented by the structural formula 1 below was used instead of the diazo compound used in Example 1. However, the diazo compound did not dissolve and the desired microcapsule solution could not be prepared.

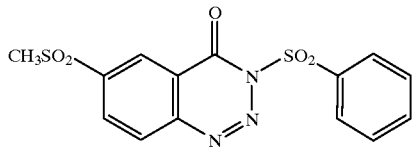

Comparative Example 2

A heat-sensitive recording material was prepared in the same manner as in Example 1, except that the diazo compound D-1 represented by the following structural formula 2 and a coupler represented by the titled Compound C-1 were used instead of the diazo compound and the coupler used in Example 1.

D-1

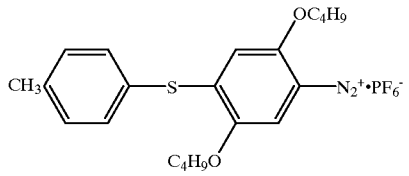

Evaluation

Tests on the following points were carried out for the heat-sensitive recording materials of Examples 1 to 6 and Comparative Example 2 respectively for evaluating their performances. The results of the evaluation are summarized in Table 1.

(Coloring test)

An image was formed by thermally printing a sample on the heat-sensitive recording material using a thermal head (KST type) manufactured by Kyocera Corp. The application power to the thermal head and the pulse width were determined such that the recording energy per unit area was 50 mJ/mm$^2$. The density of color-development of the image portion and the density of the background portion in this case were measured. When the density of the image portion is at least 1.2 and the density of the background portion is 0.1 or lower, the image is evaluated to be practically usable.

(Light-resistance test)

By using a fluorescent lamp as the tester, the heat-sensitive recording material after being recorded was irradiated by light continuously for 72 hours at 30,000 lux, and, thereafter, the density of color-development of the image portions and that of the background portion were measured. The smaller the reduction in density of color-development of the image portion and the smaller the increase in density of the background portion after irradiation by the fluorescent lamp, the more excellent the image light-resistance.

(Evaluation of storage stability before use)

The heat-sensitive recording material before recording was forcibly stored for 20 hours under the condition of 60° C. and 30% RH. After the forcible storage, the above-described color-development test was applied and the density of the color-development of the image portion and the density of the background portion were measured. When the heat sensitive recording material in the unused state is stored, the smaller the reduction in the density of color-development of the image portion and the smaller the increase in density of the background portion after the storage, the more excellent is the storage stability before use.

(Light stability test)

The entire surface of the heat-sensitive recording material before recording was irradiated by light for 10 seconds by using a fluorescent lamp having an emission center wavelength of 420 nm and an output of 40 W. Thereafter, the entire surface of the heat-sensitive recording material was further irradiated by ultraviolet light for 10 seconds by using an ultraviolet light lamp having an emission center wavelength of 365 nm and an output of 40 W. The heat-sensitive recording material was thermally printed in the same manner as in the above-described color-developing test to form an image, followed by measurement of the density of the color-development of the image portion. The smaller the reduction in the density of the color-development after being irradiated by the fluorescent lamp and the ultraviolet light lamp, the more excellent the light stability.

In the above-described tests, the density of the color-development of the image portions and the density of the background portions were measured using a Macbeth RD918 (reflection densitometer) at the Y position.

According to the present invention, there is provided a diazo compound which is stable in light having longer wavelengths from 350 nm and has excellent solubility in organic solvents. Also, according to the present invention, there is provided a heat-sensitive recording material which has excellent color-developing property, light-resistance property, and storage stability before use.

What is claimed is:

1. A heat-sensitive recording material, comprising:

a substrate; and a heat-sensitive recording layer provided on said substrate;

said heat-sensitive recording layer including at least:

a diazo compound; and a coupler to react with said diazo compound to color said diazo compound, said diazo compound being at least one compound of the compounds represented by the following general formulae (I)–(III):

general formula (I)

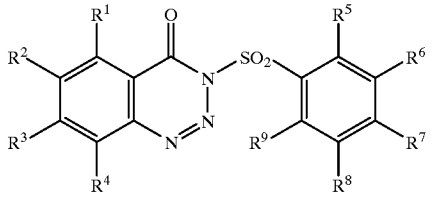

wherein, in general formula (I), each of $R^1$, $R^2$, $R^3$ and $R^4$ independently represents a group selected from the group consisting of a hydrogen atom, a halogen atom, an alkyl group, an aryl group, —$OR^{10}$, —$SR^{10}$, —$COOR^{10}$, —$CONR^{10}R^{11}$, —$SO_2R^{10}$, —$SO_2NR^{10}R^{11}$, —$COR^{10}$, a nitro group and a cyano group; each of $R^5$, $R^6$, $R^7$, $R^8$ and $R^9$ independently represents a group selected from the group consisting of a hydrogen atom, a halogen atom, an alkyl group, an aryl group, —$OR^{12}$, —$COOR^{12}$, —$CONR^{12}R^{13}$, —$SO_2R^{12}$, —$SO_2NR^{12}R^{13}$, —$COR^{12}$, a nitro group and a cyano group; each of $R^{10}$, $R^{11}$, $R^{12}$ and $R^{13}$ independently represents a group selected from the group consisting of a hydrogen atom, an alkyl group and an aryl group; further wherein, at least one of the $R^1$, $R^2$, $R^3$ and $R^4$ represents a group selected from the group consisting of —$COOR^{10}$, —$CONR^{10}R^{11}$, —$SO_2R^{10}$, —$SO_2NR^{10}R^{11}$, a nitro group and a cyano group; and at least one of the $R^5$, $R^6$, $R^7$, $R^8$ and $R^9$ represents a group selected from the group consisting of

TABLE 1

| | | | Color-developing test | | Light-resistance test | | Evaluation of storage stability before use | | Light stability test |
|---|---|---|---|---|---|---|---|---|---|
| | Diazo compound | Coupler | Density of color-development of image portion | Density of background portion | Density of color-development of image portion | Density of background portion | Density of color-development of image portion | Density of background portion | Density of color-development of image portion |
| Example 1 | A-1 | C-11 | 1.25 | 0.07 | 0.91 | 0.14 | 1.20 | 0.13 | 1.20 |
| Example 2 | A-1 | C-9 | 1.35 | 0.08 | 0.90 | 0.10 | 1.23 | 0.12 | 1.31 |
| Example 3 | A-20 | C-11 | 1.42 | 0.10 | 1.03 | 0.15 | 1.31 | 0.15 | 1.35 |
| Example 4 | A-23 | C-11 | 1.30 | 0.10 | 0.94 | 0.15 | 1.20 | 0.15 | 1.22 |
| Example 5 | A-2 | C-11 | 1.25 | 0.07 | 0.93 | 0.14 | 1.20 | 0.13 | 1.23 |
| Example 6 | A-4 | C-11 | 1.20 | 0.07 | 0.88 | 0.14 | 1.15 | 0.10 | 1.15 |
| Comparative Example 2 | D-1 | C-1 | 1.30 | 0.95 | 0.78 | 0.14 | 1.15 | 1.00 | 0.20 |

From the results shown in Table 1, each of the heat-sensitive recording materials described in Examples 1 to 6 prepared by using a diazo compound of the present invention had more excellent results in the above-described tests in comparison with a heat-sensitive recording material described in Comparative Example 2. Further, the diazo compound of the present invention used in Examples 1 to 6 had greater solubility in organic solvents in comparison with the diazo compound used in Comparative Example 2.

—$COOR^{12}$, —$CONR^{12}R^{13}$, —$SO_2R^{12}$, —$SO_2NR^{12}R^{13}$, a nitro group and a cyano group;

general formula (II)

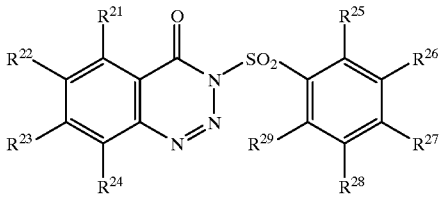

wherein, in general formula (II), each of $R^{21}$, $R^{22}$, $R^{23}$ and $R^{24}$ independently represents a group selected from the group consisting of a hydrogen atom, a halogen atom, an alkyl group, —$OR^{30}$, —$COOR^{30}$, —$SO_2R^{30}$, a nitro group, a cyano group and —$CONR^{30}R^{31}$; each of $R^{25}$, $R^{26}$, $R^{27}$, $R^{28}$ and $R^{29}$ independently represents a group selected from the group consisting of a hydrogen atom, a halogen atom, —$OR^{32}$, —$COOR^{32}$, —$CONR^{32}R^{33}$, —$SO_2NR^{32}R^{33}$, a nitro group and a cyano group; each of $R^{30}$, $R^{31}$, $R^{32}$, and $R^{33}$ independently represents a group selected from the group consisting of a hydrogen atom, an alkyl group and an aryl group; further wherein, at least one of the $R^{21}$, $R^{22}$, $R^{23}$ and $R^{24}$ represents a group selected from the group consisting of —$CONR^{30}R^{31}$, —$COOR^{30}$, —$SO_2R^{30}$, a nitro group and a cyano group; and at least one of the $R^{25}$, $R^{26}$, $R^{27}$, $R^{28}$, and $R^{29}$ represents a group selected from the group consisting of —$COOR^{32}$, —$CONR^{32}R^{33}$, —$SO_2NR^{32}R^{33}$, a nitro group and a cyano group; and general formula (III)

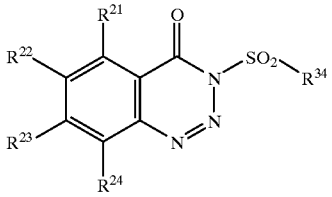

wherein, in general formula (III), each of $R^{21}$, $R^{22}$, $R^{23}$ and $R^{24}$ independently represents a group selected from the group consisting of a hydrogen atom, a halogen atom, an alkyl group, —$OR^{30}$, —$COOR^{30}$, —$SO_2R^{30}$, a nitro group, a cyano group and —$CONR^{30}R^{31}$ each of $R^{30}$ and $R^{31}$ independently represents a group selected from the group consisting of a hydrogen atom, an alkyl group and an aryl group; further wherein, at least one of $R^{21}$, $R^{22}$, $R^{23}$ and $R^{24}$ represents a group selected from the group consisting of —$CONR^{30}R^{31}$, —$COOR^{30}$, —$SO_2R^{30}$, a nitro group and a cyano group, and $R^{34}$ represents a group selected from the group consisting of the following monovalent groups

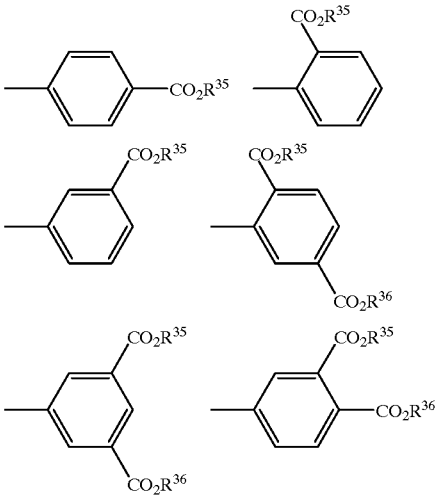

wherein each of $R^{35}$ and $R^{36}$ independently represents a group selected from the group consisting of an alkyl group and an aryl group.

2. A heat-sensitive recording material in accordance with claim 1, wherein said diazo compound is encapsulated in a microcapsule.

3. A heat-sensitive recording material in accordance with claim 2, therein said microcapsule consists of at least one of urethane or urea.

4. A heat-sensitive recording material in accordance with claim 3, wherein said coupler is a compound represented by general formula (IV) or a resonance isomer of the compound:

general formula (IV)

$$E^1—CH_2—E^2$$

wherein in general formula (IV), each of $E^1$ and $E^2$ independently represents an electron attractive group, and $E^1$ and $E^2$ may combine with each other to form a ring.

5. A heat-sensitive recording material in accordance with claim 4, further comprising an organic base.

6. A heat-sensitive recording material in accordance with claim 5, further comprising a color-developing assistant and a protective layer provided on said heat-sensitive recording layer for protecting said heat-sensitive recording layer.

* * * * *